US005344507A

United States Patent [19]

Masumoto et al.

[11] Patent Number: 5,344,507

[45] Date of Patent: Sep. 6, 1994

[54] WEAR-RESISTANT ALUMINUM ALLOY AND METHOD FOR WORKING THEREOF

[75] Inventors: Tsuyoshi Masumoto, 3-8-22, Kamisugi, Aoba-ku, Sendai-shi, Miyagi-ken; Akihisa Inoue; Kazuhiko Kita, both of Miyagi; Hitoshi Yamaguchi, Nagano, all of Japan

[73] Assignees: Tsuyoshi Masumoto, Sendai; Yoshida Kogyo KK; Teikoku Piston Ring Co., Ltd., both of Tokyo, all of Japan

[21] Appl. No.: 851,932

[22] Filed: Mar. 16, 1992

[30] Foreign Application Priority Data

Mar. 14, 1991 [JP] Japan ..... 3-074678

[51] Int. Cl.[5] ..... C22C 21/00

[52] U.S. Cl. ..... 148/437; 148/442; 419/28; 420/548; 420/550; 420/551; 420/552; 420/580; 420/590

[58] Field of Search ..... 148/437, 442; 420/548, 420/550, 551, 552, 580, 590; 419/28

[56] References Cited

U.S. PATENT DOCUMENTS 5,053,085 10/1991 Masumoto et al. ..... 148/437

FOREIGN PATENT DOCUMENTS 0112787 7/1984 European Pat. Off. .
0265307 4/1988 European Pat. Off. .
0333217 9/1989 European Pat. Off. .
0339676 11/1989 European Pat. Off. .

OTHER PUBLICATIONS

Patent Abstract of Japan, vol. 14, No. 236 (C-720 18 May 1990 & JP-A-2 061-023 (Furukawa Alum. Co. Ltd.) 1 Mar. 1990.

Patent Abstract of Japan, vol. 14, No. 236 (C-720) 18 May 1990 & JP-A-2 061 024 (Furukawa Alum. Co. Ltd.) 1 Mar. 1990.

Patent Abstract of Japan, vol. 13, No. 423 (C-638) 20 Sep. 1989 & JP-1 159 345 (Furukawa Alum. Co. Ltd.) 22 Jun. 1989.

Patent Abstract of Japan, vol. 12, No. 132 (C-490) 22 Apr. 1988 & JP-A-62 250 147 (Alum Funmatsu Yakin Gijutsu Kenkyu Kumiai) 31 Oct. 1987.

Patent Abstract of Japan, vol. 14, No. 250 (C-723) 29 May 1990 & JP-A-2 070 037 (Furukawa Alum. Co. Ltd.)

*Primary Examiner*—R. Dean
*Assistant Examiner*—Robert R. Koehler
*Attorney, Agent, or Firm*—Armstrong, Westerman, Hattori, McLeland & Naughton

[57] ABSTRACT

An aluminum-alloy, which is wear-resistant and does not wear greatly the opposed cast iron or steel, and which can be warm worked. The alloyings the following composition and structure. Composition: $Al_a$-$Si_bM_cX_dT_e$ (where M is at least one element selected from the group consisting of Fe, Co and. Ni; X is at least one element selected from the group consisting of Y, Ce, La and Mm (misch metal); Y is at least one element selected from the group consisting of Mn, Cr, V, Ti, Mo, Zr, W, Ta and Hf; a=50–85 atomic %, b=10–49 atomic %, c=0.5–10 atomic %, d=0.5–10 atomic %, e=0–10 atomic %, and a+b+c+d+e=100 atomic %. Structure: super-saturated face-centered cubic crystals and fine Si precipitates.

8 Claims, 3 Drawing Sheets

WEAR-RESISTANT ALUMINUM ALLOY AND METHOD FOR WORKING THEREOF

BACKGROUND OF INVENTION

1. Field of Invention

The present invention relates to a wear-resistant aluminum-alloy which is appropriate for weight-reduction of sliding parts. The present invention also relates to a method for working the wear-resistant aluminum-alloy.

2. Description of Related Arts

Wear-resistant aluminum-alloys are used for such sliding members, whose light weight is of importance, in a application such as the vane and the rotor of a rotary compressor, the valve-operating system of an internal combustion engine, a cylinder of a magnetic head, the cylinder of a miniature engine used for a model, and the piston of an engine. The wear-resistant aluminum-alloys are used in combination with cast iron or alloyed steel, which is the material of the opposed sliding member. The required properties of these materials are wear-resistance along with excellent strength and heat-resistance. In addition, the difference in the coefficient of thermal expansion of the opposed and sliding members should be minimal.

Al-Si alloy is well known as an aluminum alloy having excellent wear-resistance. Particularly, Al-Si alloy having Si content of from 12 to 25% by weight is used extensively. The Al-Si alloy mostly used is a cast material. In order to utilize the wear-resistance property of primary Si, coarse Si crystals, of 20 μm or more in size are formed in the cast Al-Si alloy.

The coarse primary Si of the cast Al-Si alloy increases, however, the wear of the opposed material. The strength of this Al-Si alloy is low, because it is cast material. Furthermore, any form of machining, cold working or warm working, is impossible for such alloy because the coarse primary Si is dispersed in the cast aluminum alloy. When the Si content is decreased to improve the workability, the coefficient of thermal expansion increases, thus creating a problem with regard to clearance between the sliding and opposed members.

SUMMARY OF THE INVENTION

It is an object of the present invention to provide a wear-resistant aluminum-alloy whose wear-resistance is excellent and which can decrease the wear of the opposed member as compared with the conventional cast Al-Si alloy.

It is also an object of the present invention to provide a wear-resistant aluminum-alloy having improved workability as compared with the conventional cast Al-Si alloy.

In accordance with the present invention, there is provided a wear-resistant aluminum-alloy, which has a composition expressed by $Al_aSi_bM_cX_dT_e$ (M is at least one element selected from the group consisting of Fe, Co and Ni; X is at least one element selected from the group consisting of Y, Ce, La and Mm (misch metal); T is at least one element selected from the group consisting of Mn, Cr, V, Ti, Mo, Zr, W, Ta and Hf; a=50–85 atomic %, b=10–49 atomic %, c=0.5–10 atomic %, d=0.5–10 atomic %, e=0–10 atomic %, and a+b+c+d+e=100 atomic %), and which has a structure of super-saturated face-centered cubic crystals and fine Si precipitates.

The working method according to the present invention is characterized by warm-working the above mentioned alloy at a temperature of from 300° to 400° C. The inventive warm-working advantageouly does not cause coarsening of the above-described structure.

The wear-resistance of the inventive alloy is improved mainly due to the Si precipitates. Since the Si precipitates are fine, although their amount is great, the workability is good and the opposed material is not worn out appreciably. The M, X and T dissolved in super-saturation enhance the heat-resistance and strength. The fine Si precipitates indicate that their size is substantially finer than the conventional primary Si crystals and typically less than 10 μm.

DESCRIPTION OF THE PREFERRED EMBODIMENTS

The composition of the aluminum-alloy according to the present invention is the first described.

Al in an amount less than 50 atomic % is not preferable from the viewpoint of light weight. The Al content is therefore 50 atomic % or more. On the other hand, when the Al content exceeds 85 atomic %, strength and wear-resistance are lowered to a disadvantageous point.

M is at least one element selected from the group consisting of Fe, Co and Ni and is a solute element which is dissolved in the matrix at super saturation and strengthens it. When its content is less than 0.5 atomic %, strengthening of the matrix is insufficient. On the other hand, when its content is more than 10 atomic %, brittle intermetallic compounds are formed to embrittle the material.

X is at least one element selected from the group consisting of Y, Ce, La and Mm (misch metal) and promotes the function of M to form a super-saturated solid solution of Al-M. In addition, X itself is dissolved in Al as a solid solution and enhances the heat resistance. When the content of X is less than 0.5 atomic %, its effects are not sufficient. On the other hand, when the content of X is more than 10 atomic %, the alloy becomes embrittled.

Si precipitates as fine particles 10 μm or less in size and enhances the wear-resistance of the alloy. In addition, Si determines the coefficient of linear expansion of the aluminum alloy. The coefficient of linear expansion can therefore be adjusted by adjusting the Si content. When the Si content is less than 10 atomic %, Si is not effective for enhancing the wear resistance and tends to generate intermetallic Fe-Al compound-crystals in addition to the face-centered cubic crystals. On the other hand, when the Si content is more than 49 atomic %, the strength of the material decreases.

T is at least one element selected from the group consisting of Mn, Cr, V, Ti, Mo, Zr, W, Ta and Hf, solid-solution strengthens the matrix and suppresses recrystallization up to high temperature. The heat-resistance is thus enhanced.

Cu and/or Mg, which are additives of the practical aluminum alloys, may be added to the inventive alloy up to 5 atomic %. While this addition does not greatly improve the properties, on the other hand, it does not impair the above described properties at all.

The alloy according to the present invention may be provided, for example, in the form of atomized powder. This is raw material for producing powder metallurgical products of high density and exhibits an improved workability.

X-ray diffraction. The structure revealed is shown also in Table 1.

TABLE 1

| No. | Composition (at %) Al | Si | M | X | Y | Others | Structure | Hardness (Hv) | Formation of Compound (K) |
|---|---|---|---|---|---|---|---|---|---|
| Inventive 1 | bal | 15 | Fe = 3.6 | Ce = 0.9 | — | — | FCC + Si | 360 | 653 |
| Inventive 2 | bal | 20 | Fe = 3.2 | Ce = 0.8 | — | — | FCC + Si | 350 | 653 |
| Inventive 3 | bal | 30 | Fe = 2.8 | Ce = 0.7 | — | — | FCC + Si | 350 | 653 |
| Inventive 4 | bal | 40 | Fe = 2.4 | Ce = 0.6 | — | — | FCC + Si | 340 | 653 |
| Inventive 5 | bal | 20 | Fe = 3 | Ce = 1 | — | — | FCC + Si | 350 | 623 |
| | | | Co = 4 | | | — | | | |
| Inventive 6 | bal | 20 | Ni = 1.0 | Ce = 1 | Nb = 4 | — | FCC + Si | 360 | 623 |
| Inventive 7 | bal | 20 | Fe = 3 0 | Ce = 1 | — | — | FCC + Si | 380 | 623 |
| Inventive 8 | bal | 20 | Ni = 3.0 | Ce = 1 | Zr = 1 | — | FCC + Si | 360 | 653 |
| | | | | La = 1 | | | | | |
| Inventive 9 | bal | 30 | Fe = 3.0 | Mm = 1 | Hf = 0.6 | — | FCC + Si | 360 | 630 |
| Inventive 10 | bal | 30 | Fe = 3.0 | Mm = 1 | Ti = 0.6 | — | FCC + Si | 350 | 630 |
| Inventive 11 | bal | 30 | Fe = 3.0 | Mm = 1 | Cr = 0.8 | — | FCC + Si | 350 | 640 |
| Inventive 12 | bal | 30 | Fe = 3.0 | Mm = 1 | Mn = 1 | — | FCC + Si | 360 | 650 |
| Inventive 13 | bal | 30 | Fe = 3.0 | Mm = 1 | V = 0.8 | — | FCC + Si | 360 | 660 |
| Inventive 14 | bal | 30 | Fe = 3.0 | Mm = 1 | W = 0.6 | — | FCC + Si | 355 | 630 |
| Inventive 15 | bal | 30 | Fe = 3.0 | Mm = 1 | Ta = 0.6 | — | FCC + Si | 375 | 640 |
| Comparative 1 | bal | 5 | Fe = 3.0 | Ce = 0.9 | — | — | FCC | 150 | 630 |
| Comparative 2 | bal | 20 | — | — | — | Cu = 3 | FCC | 100 | 470 |
| Comparative 3 | bal | 20 | — | — | — | Mg = 1.0 | FCC | 80 | 460 |
| Comparative 4 | bal | 40 | — | — | — | Cu = 3 | FCC + Si | 70 | 470 |
| Comparative 5 | bal | 30 | Fe = 3.0 | — | — | — | FCC + Si | 100 | 630 |
| Comparative 6 | bal | 5 | — | Mm = 1 | Cr = 1 | — | FCC | 60 | 620 |

The alloy according to the present invention may be provided, for example, in the form of a melt-quenched ribbon. The single-roll method for melt quenching can be used for forming the ribbon. This is cut and then used as a sliding member. The alloy according to the present invention may also be provided in the form of a wrought product such as a pressed or extruded product. This is subsequently finally machined and used as a sliding member. In this case, the aluminum alloy having the above-described composition is rapidly cooled by atomizing method at the solidification speed of $10^{4°}$ C./sec or more to obtain powder. This powder is then extruded or hot-pressed at a temperature of from 300° to 400° C. into a form of a semi-finished sliding material, for example, a cylinder-like shape. According to a specific embodiment of the extrusion method, the powder is enclosed in an aluminum can under vacuum and is then extruded under a pressure of 10 ton/cm$^2$ at a temperature of 350±30° C. The sliding members can therefore be mass-produced by the method described above. The structure of the wrought product maintains the features of the cast structure, that is, the super-saturated Al solid solution and fine Si crystals precipitated during the casting, are present and, further, Si crystals 0.1 to 5 μm in size are dispersed uniformly in the Al solid-solution.

The present invention is hereinafter described with reference to the drawings.

EXAMPLE 1

Mother alloys having the compositions given in Table 1 were produced by high-frequency melting. These mother alloys were melt-quenched by a single-roll apparatus to produce ribbons 0.02 mm in thickness and 1 mm in width. These ribbons were subjected to The X-ray diffraction revealed that the structure of Al was super-saturated solid solution of a -Al, in which the alloying elements other than Si are solutes. In this matrix, Si particles from 0.1 to 5 μm in size were precipitated and dispersed.

Meanwhile, non-melt quenched materials were produced in several compositions in accordance with the present examples. The obtained materials were brittle, because coarse Si particles 15 μm or more in size were dispersed, and brittle intermetallic compounds, such as $FeAl_3$ and $Fe_2Al_5$, were precipitated and dispersed.

The precipitating temperature of compounds and hardness were measured for each ribbon and are shown in Table 1. The hardness is measured by a micro Vickers hardness tester under 25g of load. The precipitation temperature was measured by a scanning differential thermal analysis-curve at a heating rate of 40° C./min and an X-ray diffractometry.

As is apparent from Table 1, the inventive materials have a hardness of from Hv 150 to 400 and are hence very hard. The precipitating temperature of compounds is the one at which the super-saturated solid solution is destroyed and is an index indicating heat-resistance and the upper limit of the working temperature.

Figure 4:
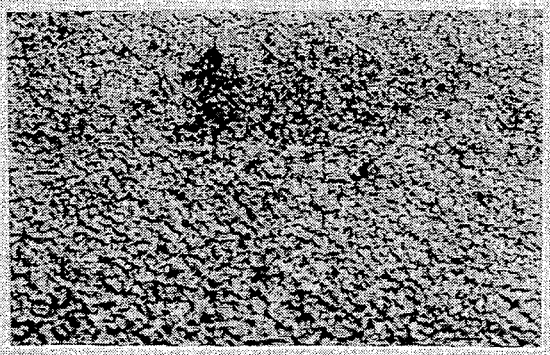
FIG. 4 is a metal microscope photograph of the structure of inventive example 1, magnified 500 times.

The metal microscope structure of inventive example 2 is shown in FIG. 4 magnified 500 times.

EXAMPLE 2

The alloys having the compositions of inventive examples 1, 2, 3, and 4, as well as the comparative examples 1 and 2 were pulverized by high-pressure atomizing. The average particle diameter of the atomized powder was 15 μm. The structure of the atomized powder was FCC+Si for the inventive examples and FCC for the comparative examples. The powder was enclosed in a container made of Cu, which was then sealed with a Cu cap. Vacuum degassing ($1\times10^{-5}$) was then carried out. The powder was then pressed at 620K by means of a press machine to obtain a billet. The billet was then set in a container of an extrusion machine and was warm-extruded at 650K (377° C.) at an extrusion ratio of 10 to obtain round bars. The structure of the extruded bars was identified by X-ray diffraction. The structure as in the melt-quenched state was maintained after the extrusion, that is, the atomized and then extruded powder was FCC+Si for the inventive examples and FCC for the comparative examples. The size of the Si particles might have been changed due to their growth during warm working but this change could not be detected by observation with an optical microscope.

Figure 1:
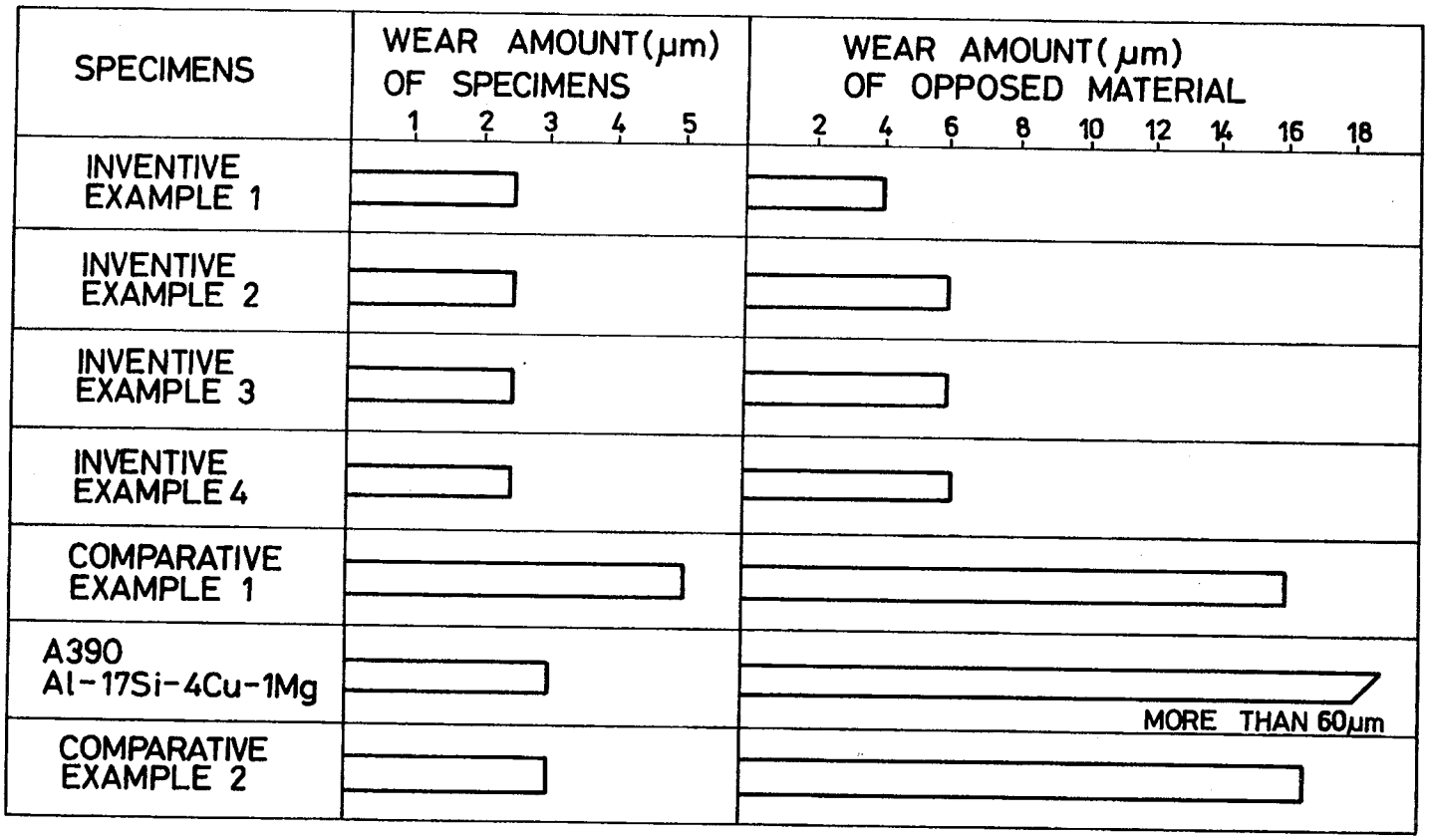
FIG. 1 is a graph of the results of wear-resistance test.
Figure 2:
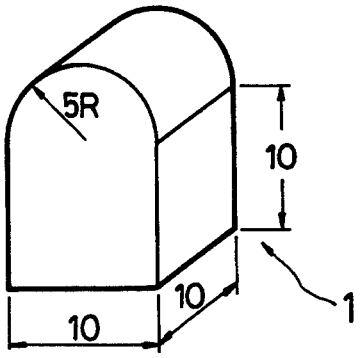
FIG. 2 shows a sample of wear-resistance test.
Figure 3:
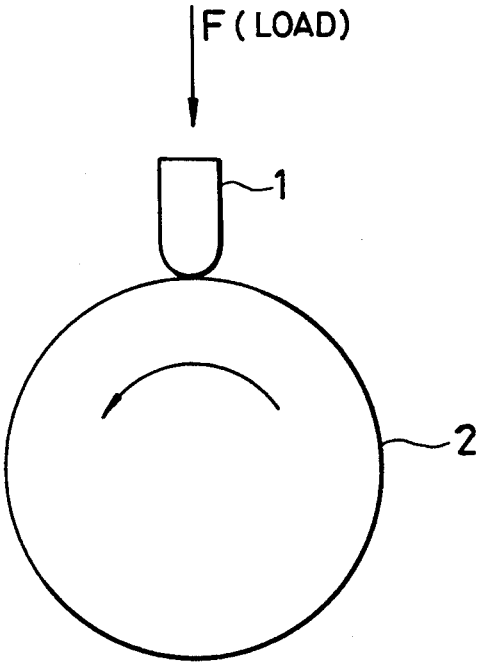
FIG. 3 shows a method of wear-resistance test.

The extruded materials as described above were machined into a specimen 1 as shown in FIG. 2 and were brought into contact with a rotor 2 as shown in FIG. 3, which was an opposed material consisting of eutectic cast iron. Wear amounts of the specimen 1 and rotor 2 were measured under the conditions of: 100kg/mm$^2$ of load; 1m/sec of sliding speed; and oil lubrication (Kyoseki lefoil NS-4GS (trade name)). The results are shown in FIG. 1.

A390, which is a known wear-resistant aluminum alloy, wears the rotor 2 greatly. The inventive materials themselves exhibit a small wear amount and do not wear the opposing material greatly. Therefore, the inventive materials exhibit excellent compatibility with the opposing material.

We claim:

1. A wear-resistant aluminum-alloy, which has a hardness of 340–400 Hv and has a composition expressed by $Al_aSi_bM_cX_dT_e$ (M is at least one element selected from the group consisting of Fe, Co and Ni; X is at least one element selected from the group consisting of Y, Ce, La and Mm (misch metal); T is at least one element selected from the group consisting of Mn, Cr, V, Ti, Mo, Zr, W, Ta and Hf; a=50–85 atomic %, b=10–49 atomic %, c=0.5–10 atomic %, d=0.5–10 atomic %, e=0–10 atomic %, and a+b+c+d+e=100 atomic %), and which has a structure of super-saturated face centered cubic crystals and fine Si precipitates from 0.1 to 10 μm in size and is free from intermetallic compounds.

2. A wear-resistant aluminum-alloy according to claim 1, wherein said alloy is a melt-quenched ribbon.

3. A wear-resistant aluminum-alloy according to claim 1, wherein said alloy is warm-worked.

4. A wear resistant aluminum-alloy according to claim 2 or 3, wherein said alloy is warm-worked.

5. Sliding members consisting of a wear-resistant aluminum-alloy according to claim 4, which is in slidable contact with an opposed member which consists of steel or cast iron.

6. A method for working a wear-resistant aluminum-alloy which has a composition expressed by $Al_aSi_bM_cX_dT_e$ (M is at least one element selected from the group consisting of Fe, Co and Ni; X is at least one element selected from the group consisting of Y, Ce, La and Mm (misch metal); T is at least one element selected from the group consisting of Mn, Cr, V, Ti, Mo, Zr, W, Ta and Hf; a=50–85 atomic %, b=10–49 atomic %, c=0.5–10 atomic %, d=0.5–10 atomic %, e=0–10 atomic %,and a+b+c+d+e=100 atomic %), and which has a structure of super-saturated face centered cubic crystals and fine Si precipitates from 0.1 to 10 μm in size and is free from intermetallic compounds, the method comprising subjecting the aluminum alloy to warm working at a temperature of from 300° to 400° C. to yield an alloy having a structure of super-saturated face centered cubic crystals and fine Si precipitates from 0.1 to 10 μm in size and free from intermetallic compounds.

7. A method according to claim 6, wherein atomized powder is subjected to extrusion of pressing at a temperature of from 300° to 400° C.

8. A method according to claim 7, wherein said atomized powder is enclosed and sealed in a can under vacuum and is then pressed into a billet, which is then subjected to said extrusion or pressing.

* * * * *